US007357261B2

(12) United States Patent
Yamamoto et al.

(10) Patent No.: US 7,357,261 B2
(45) Date of Patent: Apr. 15, 2008

(54) PACKING DEVICE FOR PLATE-LIKE ARTICLES

(75) Inventors: Takashi Yamamoto, Osaka (JP); Satoru Yamamoto, Sakai (JP)

(73) Assignee: Nippon Sheet Glass Co., Ltd., Tokyo (JP)

( * ) Notice: Subject to any disclaimer, the term of this patent is extended or adjusted under 35 U.S.C. 154(b) by 404 days.

(21) Appl. No.: 10/516,948

(22) PCT Filed: Sep. 30, 2002

(86) PCT No.: PCT/JP02/10221

§ 371 (c)(1),
(2), (4) Date: Dec. 16, 2004

(87) PCT Pub. No.: WO04/000691

PCT Pub. Date: Dec. 31, 2003

(65) Prior Publication Data

US 2005/0205500 A1 Sep. 22, 2005

(30) Foreign Application Priority Data

Jun. 19, 2002 (JP) ..... 2002-178583

(51) Int. Cl.
*A47G 19/08* (2006.01)

(52) U.S. Cl. ..... 211/41.14

(58) Field of Classification Search ..... 211/41.14, 211/41.1, 175, 49.1; 206/451, 454, 449
See application file for complete search history.

(56) References Cited

U.S. PATENT DOCUMENTS 2,839,198 A 6/1958 Lefevre et al.
2,978,270 A * 4/1961 Verheggen ..... 294/67.22
3,955,676 A * 5/1976 Hansen et al. ..... 206/251
4,278,171 A * 7/1981 Millhoan ..... 206/451
5,145,073 A 9/1992 Kitagawa et al. ..... 211/41
5,379,904 A 1/1995 Brown
5,755,339 A * 5/1998 Belanger et al. ..... 211/41.14
5,906,282 A * 5/1999 Aldrich et al. ..... 211/41.14

FOREIGN PATENT DOCUMENTS

DE 38 43 187 C1 6/1990
JP 07-267290 10/1995

* cited by examiner

*Primary Examiner*—Sarah Purol
(74) *Attorney, Agent, or Firm*—Edwards Angell Palmer & Dodge LLP

(57) ABSTRACT

A packing device includes a base frame, a rear frame and a front pillar. Glass plates (G) are disposed on the base frame with the glass plates leaned against the rear frame. The glass plates (G) are held by a pressing device with the glass plates (G) pressed toward the rear frame. The pressing device has pressing members to be arranged along front both sides of the glass plates (G), and locking members each removably disposed between the pressing member and the front pillar. The locking member disposed between the front pillar and the pressing member is pressed downwardly along the front pillar to be disposed between the front pillar and the pressing member with the locking member engaged therebetween, whereby the pressing member presses a front surface of the glass plates (G). According to this packing device, packing and unpacking operations of glass plates (G) can be simply and assuredly performed while attaining structural simplification and cost reduction.

3 Claims, 5 Drawing Sheets

PACKING DEVICE FOR PLATE-LIKE ARTICLES

BACKGROUND OF THE INVENTION

1. Field of the Invention

The present invention relates to a packing device for plate-like articles preferably used for packing plate-like articles, such as glass plates, at the time of transporting or storing them.

2. Description of the Related Art

In the so-called one-way type packing device for, e.g., glass transportation designed to be discarded after transportation, a wooden device is mainly used. However, in recent years, because the export and import of wooden products have been severely restricted in light of ecological preservation, etc., as a packing device used especially for export and import, metallic devices are now preferably used.

A conventionally known metallic packing device for glass plates includes, for example, a base frame, a front frame and a rear frame upwardly disposed at the front and rear end portions of the base frames respectively, and a pressing device provided at the front frame. In this packing device, a plurality of glass plates arranged in the front-and-rear direction of the base frame are disposed on the base frame with the glass plates leaned against the rear frame, and in this state, the glass plates are held in a stable condition by being pressed toward the rear frame with the pressing device.

In the aforementioned conventional packing device for glass plates, glass plates are pressed and fixed with a pressing device. As such a pressing device, a screw mechanism, for example, is used to press the pressing device against the surface of glass plates by a handle rotation operation.

However, the handle rotation operation requires a tremendous amount of labor and time for a worker, and it is rather troublesome in a packing operation. Also, there are such problems that at the time of taking out the glass plates, troublesome handle rotation operation is required to release the pressing force against the glass plates, while the glass plate take-out operation itself also is troublesome.

Furthermore, a screw mechanism used as a pressing device is generally complicated in structure, and it is expensive. Especially, when a screw mechanism is employed in the so-called one-way type packing device, it may result in cost rise.

On the other hand, as a method for fixing glass plates to a packing device other than the method using the aforementioned pressing device, a method of binding and fixing glass plates to a packing device using, for example, iron bands, is known. However, also in this method, band tightening operations require tremendous labor and time, which makes the packing work difficult. Also, the cases where glass plates are bound with bands, it is necessary to cut the bands at the time of unpacking. Once the bands are cut, it cannot be used again. Under this situation, there is a problem that when bands are cut, for example, for baggage screening at the time of importation, unless glass plates are bound with new bands, etc., the glass plates cannot be transported by a track, etc.

The present invention is made in order to solve the problems of the aforementioned conventional technologies, and aims to provide a packing device for plate-like articles capable of easily and assuredly performing packing and unpacking of plate-like articles while simplifying the structure and reducing the cost thereof.

The present invention also aims to provide a packing device for plate-like articles excellent in versatility capable of repeatedly packing and unpacking operations.

SUMMARY OF THE INVENTION

A packing device for plate-like articles comprises a base frame, a pair of rear frames upwardly disposed at rear both sides of the base frame so that the plate-like article to be packed is leaned against the rear frame in a rearwardly leaned posture, a pair of front pillars upwardly disposed at front both sides of the base frame, and a pressing device for pressing and holding the plate-like article disposed on the base frame toward the rear frame, wherein the pressing device has a pair of pressing members to be arranged in a rearwardly leaned manner along front both sides of the plate-like article, locking members each removably disposed between the corresponding pressing member and front pillar, and guide members each for guiding the locking member in an up-and-down direction along the front pillar, wherein in a state in which the plate-like article is disposed on the base frame in a rearwardly leaned manner, the locking members each disposed between the corresponding front pillar and pressing member are pressed downwardly along the front pillar to be disposed between the front pillar and the pressing member with the locking member engaged therebetween, whereby the pressing member presses a front surface of the plate-like article.

In the packing device for plate-like articles according to this invention, at the time of packing, by simply disposing the locking members between the front pillar and the pressing member, the plate-like articles can be securely held by the pressing member in a pressed manner. On the other hand, at the time of unpacking, by removing the locking members from between the front pillar and the pressing member to release the engagement between these members, the pressing of the plate-like articles by the pressing member can be released. Thus, the pressing operation of the plate-like articles and the releasing operation thereof can be performed easily only by inserting and removing operations of the locking members, and therefore packing and unpacking operations of plate-like articles can be performed easily.

Furthermore, the locking members and the pressing member as the plate-shaped article pressing device are very simple in structure as compared with a structural member of a pressing device using, for example, a screw mechanism, and therefore structural simplification and cost reduction can be attained, and they can be preferably employed as the so-called one-way type disposal packing device.

Furthermore, in this invention, because packing and unpacking operations can be performed repeatedly by the insertion and release operation of the locking members, a packing operation can be easily performed even after an unpacking operation and a re-transportation after the unpacking can be performed without problem.

It is preferable that the guide member is constituted by a U-shaped groove portion provided at the locking member and opened to a front pillar side, and the U-shaped groove portion is slidably fitted on the pillar along the longitudinal direction thereof, whereby the locking member is slidably guided by the front pillar.

That is, in this case, the locking member can be correctly guided along the front pillar, which can assuredly prevent problems such as detachment as a result of displacement of the locking member.

Furthermore, in the present invention, it is preferable to employ the structure in which the pressing member has a grooved-shape pressing plate disposed along an up-and-down direction with its opened groove direction faced to the front pillar, and the locking member is slidably inserted in a groove of the pressing plate.

In the case of employing this structure, the locking member can be correctly guided along the pressing member, which can prevent problems such as detachment due to displacement of the locking member.

Furthermore in the present invention, it is preferable to employ the structure equipped with an upper bridging bar detachably connecting corresponding upper end portions of the front pillar and rear frame. In this case, the strength of the entire packing device can be enhanced while keeping the structure simple.

Furthermore, in the present invention, it is preferable to employ the structure in which the base frame, the rear frame, the front pillars and the pressing member are made of metal and cushioning materials are provided at their plate-like article contact portions. According to this structure, the strength of the entire packing device can be increased, and even in the case of packing easy-to-brake plate-like members such as glass plates, it is possible to securely pack such plate-like members without causing breakage due to the cushion functions of the cushion material.

The locking member can include an upper locking member and a lower locking member smaller than the upper one. In cases where a plurality of locking members are used, the pressing member can be pressed at a plurality of portions, enabling more secure pressing of the plate-like articles.

Other objects and the features of this invention will be apparent more clear from the following embodiments.

BRIEF DESCRIPTION OF THE DRAWINGS

FIG. 4 shows a pressing member applied to the packing device according to the embodiment, wherein

FIG. 5 shows an upper locking member of the pressing member applied to the packing device according to the embodiment, wherein

FIG. 6 shows a lower locking member of the pressing member applied to the packing device according to the embodiment, wherein

DETAILED DESCRIPTION OF AN EXEMPLARY EMBODIMENT

Figure 1:
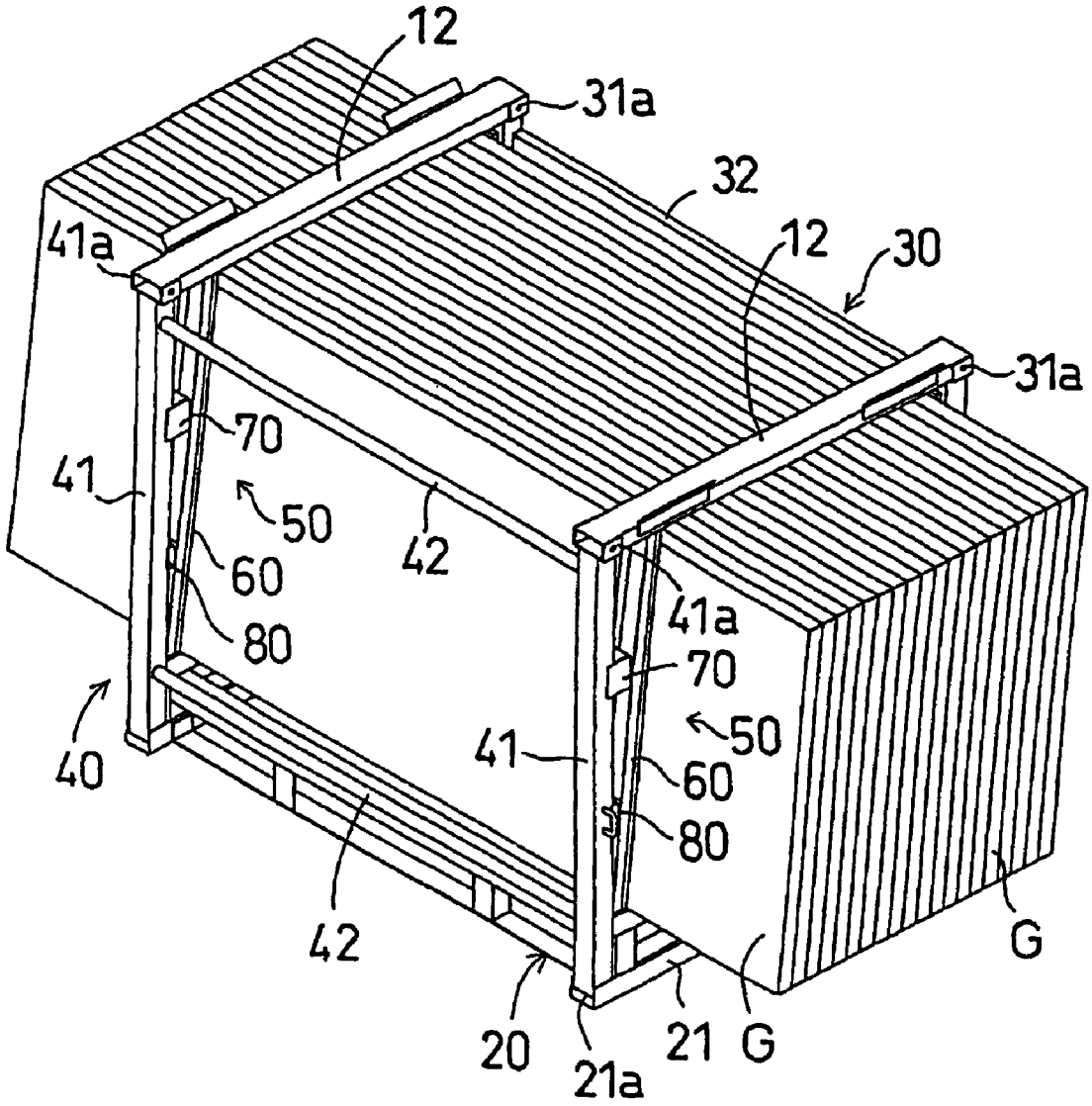
FIG. 1 is a perspective view showing a packing device in a glass plate packed state according to an embodiment of the present invention.
Figure 2:
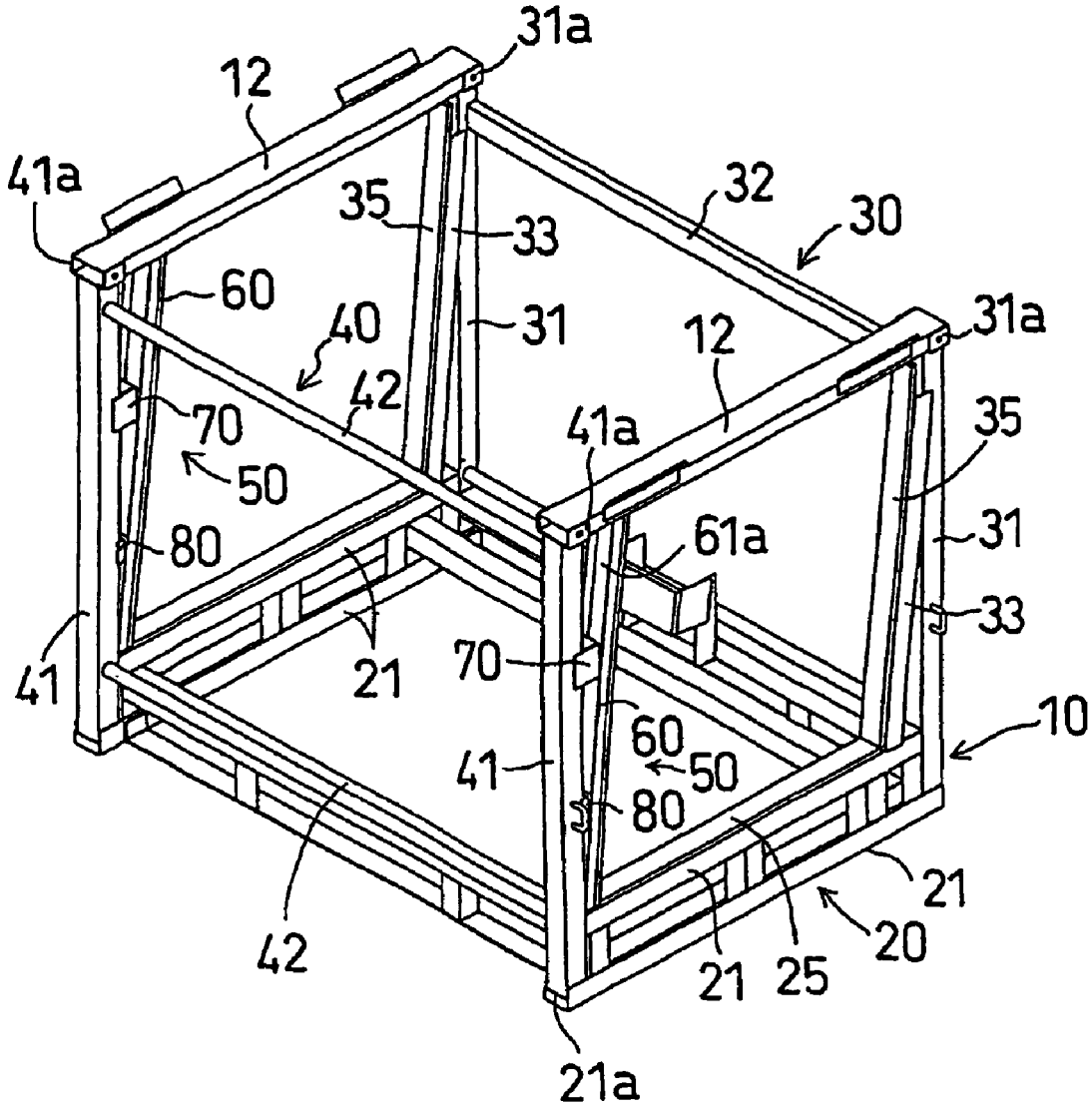
FIG. 2 is a perspective view of the packing device according to the embodiment.
Figure 3:
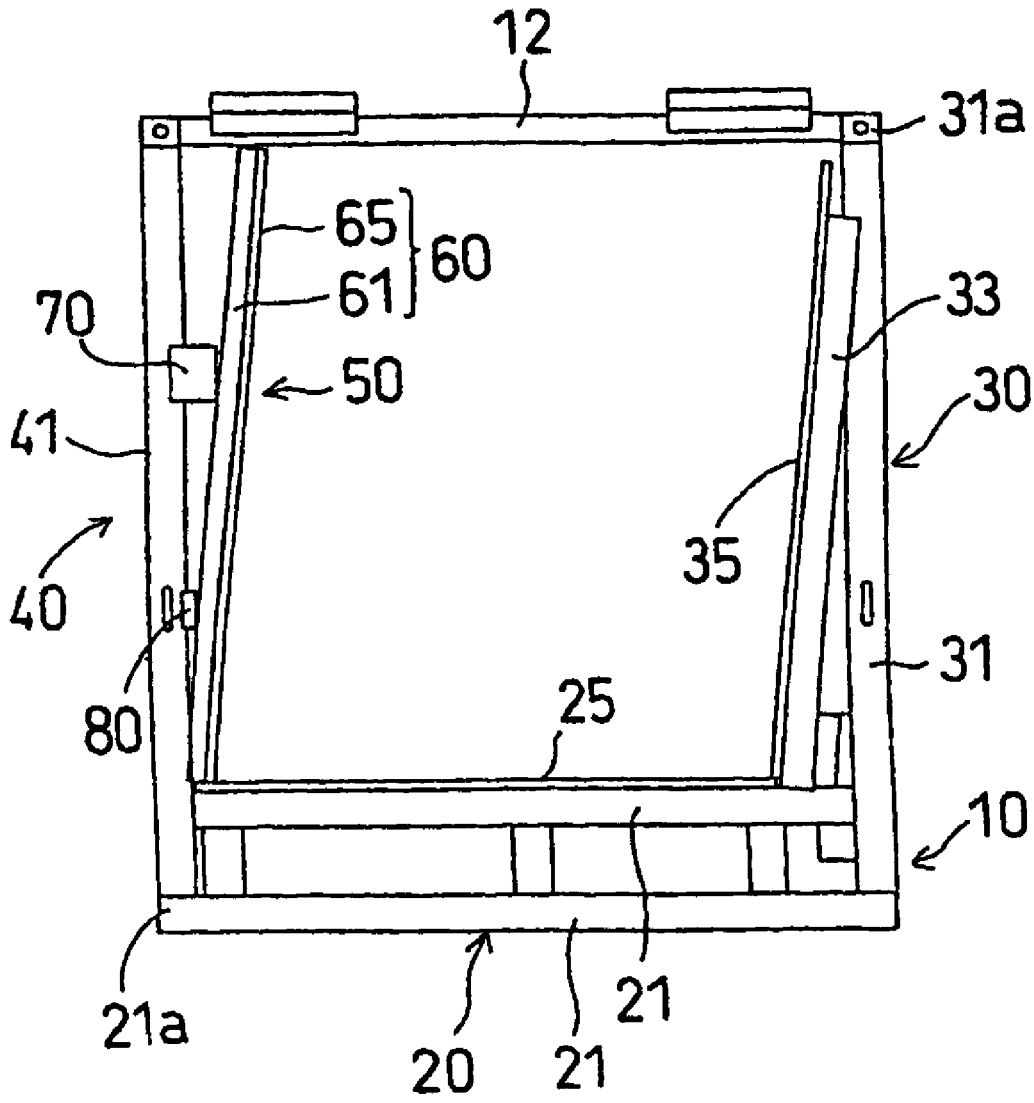
FIG. 3 is a side view of the packing device according to the embodiment.

FIGS. 1 to 3 are a perspective view showing a packing device for glass plates according to an embodiment of the present invention respectively.

As shown in these figures, the packing device of this embodiment is made of metal, and is provided with, as fundamental structural elements, a packing device main body (10) having a rear frame (30) to be uprightly attached to the rear end edge of the base frame (20), a front frame (40) to be uprightly attached to the front end edge of the base frame (20), upper bridging bars (12) (12) to be assembled so as to bridge the upper ends of the front and rear frames (40) (30), and glass plate pressing devices (50) each to be disposed at the front side of glass plates (G) to press the glass plates (G) toward the rear frame (30).

The base frame (20) of the packing device main body (10) is formed into a rectangle shape by a plurality of metal angle pipe members, and the upper and lower two beam members (21) are arranged at both sides along a front-and-rear direction.

The lower beam member (21), has a front end which is arranged so as to project forward, and its front projected portion constitutes a fitting portion (21*a*) for fitting and fixing the front pillar (41) which will be explained later.

In addition, a cushion member (25) having elasticity is attached to the upper surface of the upper beam member (21).

The rear frame (30) is fixed to both rear sides of the base frame (20) in a vertical disposition, and includes rear pillars (31) (31) of metal angle pipe members, and an upper connecting member (32) of a metal angle pipe member connecting the upper portions of the rear pillars (31) (31).

In addition, at the front sides of the rear pillars (31) (31) of the packing device main body (10), rearwardly inclined members (33) (33) are arranged along the up-and-down direction, and a cushion member (35) having elasticity is attached on the front side of each inclined member (33).

Furthermore, at the upper ends of both rear pillars (31) (31) of the rear frame (30), U-shaped metallic connectors (31*a*) (31*a*) each for detachably connecting the rear end portion of the upper bridging bar (12) is fixed.

The front frame (40) is provided with front pillars (41) (41) of metal angle pipe members at both sides and upper and lower connecting members (42) (42) of metal pipe members for connecting the upper and lower portions of the front pillars (41) (41).

At the upper ends of both front pillars (31) (31), U-shaped metallic connectors (41*a*) (41*a*) for detachably connecting the front end portions of the upper bridging bars (12) are fixed.

In the packing device according to this embodiment, it is configured so as to assemble into a cubit lattice-like structure by fitting the lower ends of both pillars (41) (41) of the front frame (40) into the fitting portions (21*a*) (21*a*) located at the front end of the front base frame (20) of the packing device main body (10) to be fixed therein, fitting the front and rear ends of the upper bridging bar (12) in the upper side connectors (41*a*) (31*a*) provided on the front pillar (41) and the rear pillar (31) and then fixing them with pins.

On the other hand, the glass plate pressing device (50) is provided with, as its fundamental structure, right and left pressing members (60), upper locking members (70) and lower locking members (80).

Figure 4A:
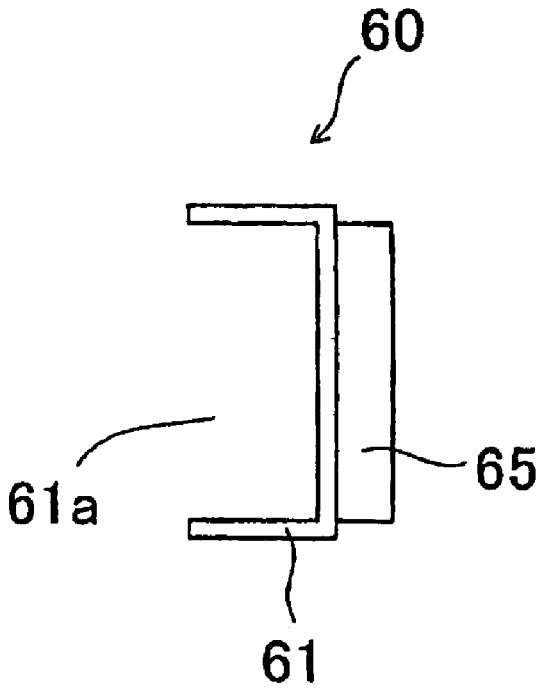
FIG. 4A is a plan view thereof.
Figure 4B:
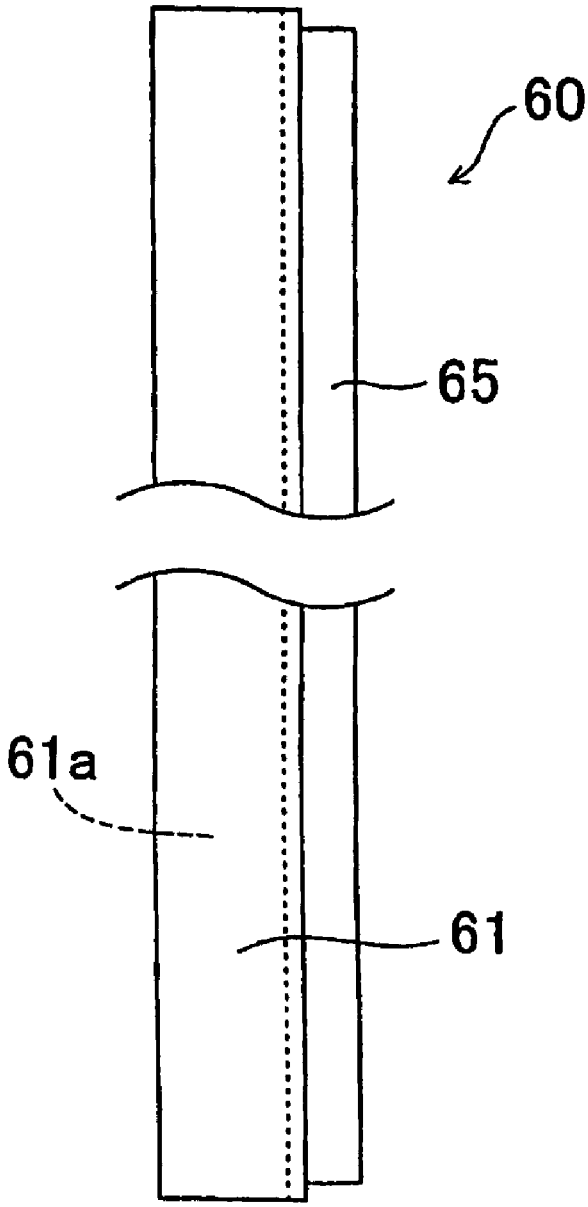
FIG. 4B is a side view thereof.

As shown in FIG. 4, the pressing member (60) is provided with a channel-shaped metallic pressing plate (61) of a certain length, and a cushion member (65) having elasticity is attached to the external bottom wall of the pressing plate (61). The pressing plate (61), as discussed later, has a groove portion which constitutes a guide groove (61*a*) for guiding the locking members (70) (80).

Figure 5A:
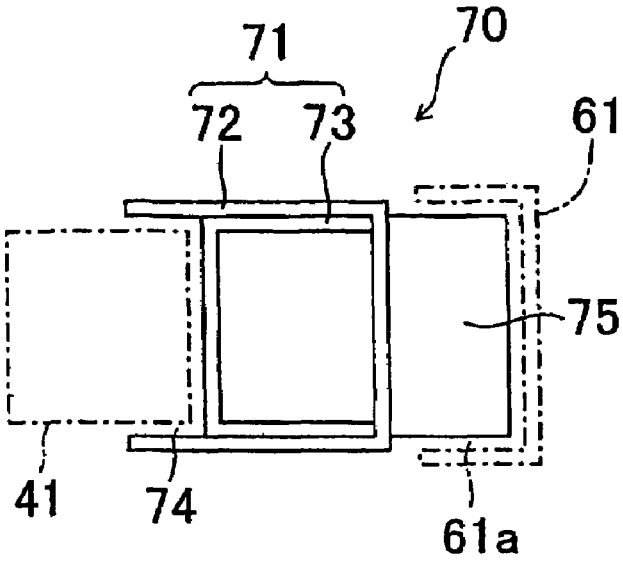
FIG. 5A is a plan view thereof.
Figure 5B:
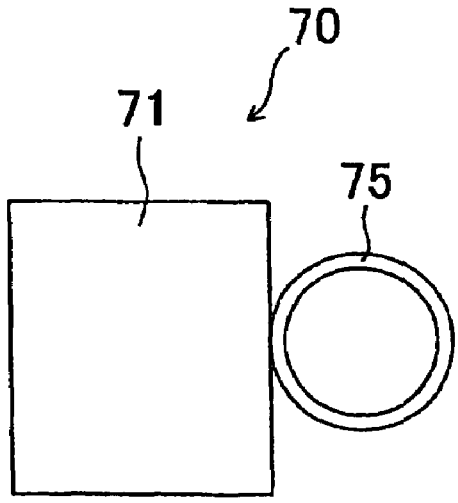
FIG. 5B is a side view thereof.

As shown in FIG. 5, the upper locking member (70) is provided with, as fundamental elements, a slider (71) and a stopper (75).

The slider (71) is constituted by an outer member (72) and an inner member (73) each having a U-shape as seen from the top. The outer member (72) and the inner member (73) are disposed in an opposed manner, and the inner member (73) is fitted in the U-shaped groove portion of the outer member (72) and fixed therein. At this time, each end portion of the outer members (72) is arranged so as to be projected, so that each end portion and the bottom wall of the inner member (73) form a U-shaped groove portion (74) having a U-shape as seen from the top. The U-shaped groove portion (74) is formed to have a size capable of outwardly fitting on the rear portion of the aforementioned front pillar (41), so that in the outwardly fitted state the slider (71) can be guided in the up-and-down direction along the front pillar (41).

The stopper (75) is constituted by a small diameter short cylindrical pipe member, and is fixed to the external surface of the bottom wall of the outer member (72) of the slider (71). This stopper (75) is constituted so as to be slidably inserted in the groove portion of the aforementioned pressing plate (61).

Figure 6A:
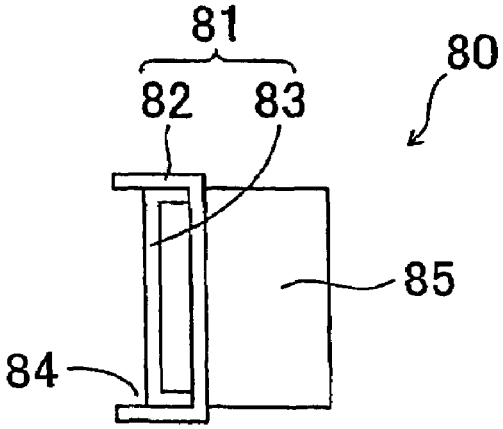
Figure 6B:
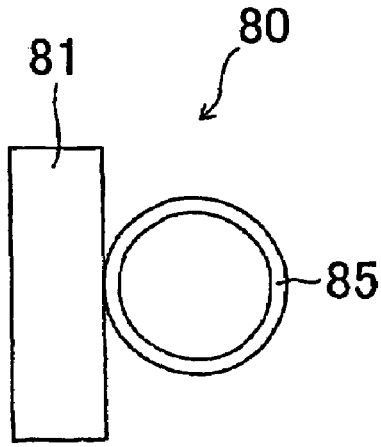

As shown in FIG. 6, in the lower locking member (80), the front-to-back-length of the outer member (82) and that of the inner member (83) of the slider (81) are set to be shorter than that of the aforementioned upper locking member (70).

Because the other structure is substantially the same as the aforementioned upper locking member (70), duplicative explanation will be omitted by allotting corresponding reference numerals to the same or corresponding portions.

Although this embodiment shows the case in which two, i.e. upper and lower, locking members (70) (80) are employed, one locking member or three or more locking members can be employed.

The packing device according to this embodiment is provided with the aforementioned structural elements, and packs glass plates (G) as follows.

First, a plurality of glass plates (G) are placed on the base frame (20) with the glass plates leaned against the inclined members (33) of the rear frame (30) of the packing device main body (10). At this time, the glass plates (G) are arranged in a rearwardly tilted posture at an angle corresponding to the inclined members (33).

Next, the pressing members (60) of the glass plate pressing devices (50) are arranged along the up-and-down direction at predetermined positions at both sides of the surface of the up-front glass plate (G). At this time, the cushion member (35) of the pressing member (60) comes into contact with the glass plate surface in a rearwardly leaned posture along the glass plate surface, and the guide groove (61*a*) of the pressing plate (61) is arranged to be opened toward the front.

Then, the lower ends of both pillars (41) (41) of the front frame (40) are fitted in the front end fitting portion (21*a*) (21*a*) of the base frame (20) and fixed thereto, and the front and rear end portions of the upper bridging bar (12) are fitted in the upper end connectors (41*a*) (31*a*) provided on the front pillar (41) and the rear pillar (31) and fixed thereto with pins. In this state, the front pillars (41) (41) are arranged at positions corresponding to the pressing member (60).

Thereafter, at upper and lower positions between the front pillar (41) and the pressing member (60), the upper and lower locking members (70) (80) are disposed respectively. At this time, the U-shaped groove portion (74) (84) of each locking member (70) (80) is outwardly fitted on the rear portion of each front pillar (41) in a slidable manner, and the stopper (75) (85) is fitted in the guide groove (61*a*) of the pressing plate (61) in a slidable manner. Thus, the locking members (70) (80) can be disposed between the front pillar (41) and the pressing member (60) in a slidable manner in the up-and-down direction.

Thereafter, the locking members (70) (80) are pushed downward to strongly press the pressing member (60) against the glass plates (G). As a result, the locking members (70) (80) are disposed between the front pillar (41) and the pressing member (60) in a pinched manner. This prevents the locking members from being slipped upwardly due to contact friction between both members (41) (60), causing both members (41) (60) to be locked assuredly. As a result, the glass plates (G) are held by the pressing members (60) with the glass plates pressed toward the rear frame (30).

Thus, in this embodiment, only by placing locking members (70) (80) between the front pillar (41) and the pressing member (60), the glass plates (G) can be assuredly pressed against the rear frame side. Therefore, a packing operation can be performed easily without troublesome works such as handle rotation operations and band tightening operations.

In this embodiment, when vibration occurs during transportation of the packing device, the locking members (70) (80) of the pressing device (50) tend to descend by its own weight and vibration. This downward movement further increases the pushing power of the pressing member (60) against the glass plates (G), causing the glass plates (G) to be further pressed and held by the pressing member (60). Therefore, irrespective of vibration to be occurred during transportation, the packing state of the glass plates (G) can be well maintained, which in turn can assuredly prevent, for example, troubles, such as shakes, displacement and shifting of the glass plates (G), can certainly be prevented.

On the other hand, when taking out the packed glass plates (G), the locking members (70) (80) of the pressing device (50) are pushed upward. In this way, after releasing the locking state by removing the locking members (70) (80) from between the front pillar (41) and the pressing member (60), the upper bridging bar (12) and the front frame (40) are detached. Accordingly, because the front side of the glass plates (G) is opened, the glass plates (G) can be taken out.

Thus, simply pushing the locking members (70) (80) upward causes a release of pressure against the glass plates (G). Therefore, it is unnecessary to perform a troublesome pressed state releasing operation, such as handle rotation operation, resulting in an easy glass plate take out operation.

Furthermore, in this embodiment, the pressing member (60) and the locking member (70) (80) constituting the glass plate pressing device (50) are simple in structure as compared with structural members such as screw-type pressing devices. Therefore, structural simplification and cost reduction can be attained. For this reason, especially, even in the so-called one-way type disposal packing device, disadvantageous with respect to cost can be minimized. Accordingly, it can be suitably applied to the so-called one-way type device as well.

Furthermore, packing and unpacking of glass plates (G) can be performed repeatedly by disposing the locking members (70) (80) in and removing them from between the front pillar (41) and the pressing member (60). Therefore, for example, even if unpacked for a baggage screening at the time of import, after such inspection, it can be packed again to transport the glass plates (G) without any trouble. Thus, this device can easily perform a packing operation even after an unpacking operation, and transportation after unpacking operation can also be performed without any restriction, and therefore has notable versatility.

In the aforementioned embodiment, although the explanation is directed to the case in which the present invention is applied to the case where glass plates are packed, the present invention is not restricted only to it, but also can be applied to a packing device for packing various plate-like articles other than glass plates.

As mentioned above, according to this packing device for plate-like articles, at the time of packing, by simply disposing the locking members (70) (80) between the front pillar (41) and the pressing member (60), the plate-like articles (G) can be assuredly held by the pressing member (60) with the articles pressed toward the rear frame side. On the other hand, at the time of unpacking, by simply removing the locking members (70) (80) from between the front pillar (41) and the pressing member (60) to release the engagement between these members, the pressing of the plate-like articles (G) by the pressing member (60) can be released. Thus, because the pressing operation of the plate-like articles (G) and the releasing operation thereof can be performed easily only by insertion and release operations of the locking members (70) (80), a packing operation of plate-like articles (G) can be performed easily. Furthermore, the locking members (70, 80) and the pressing member (60) as the plate-shaped article pressing device are simple in structure, and therefore structural simplification and cost reduction can be attained, and they can be preferably employed as the so-called one-way type disposal packing device. In addition, since packing and unpacking operations can be performed repeatedly by the insertion and release operation of the locking members (70) (80), the packing operation can be easily performed even after an unpacking operation, and also re-transportation after the unpacking operation can be performed without problem, resulting in notable versatility.

In the present application, when the U-shaped groove portion (74) (84) of the locking members (70) (80) is slidably outwardly fitted on a front pillar (41), or when the locking members (70) (80) are slidably fitted in the guide grooves (61*a*) of the pressing members (60), the locking members (70) (80) can be guided correctly along the front pillar (41) or the pressing device. There is an advantage that faults, such as detachment due to displacement of the locking members (70) (80), can be prevented.

This application claims priority to Japanese Patent Application No. 2002-178583 filed on Jun. 19, 2002, the entire disclosure of which is incorporated herein by reference in its entirety.

The terms and descriptions in this application are used only for explanatory purposes and the present invention is not limited to these terms and descriptions. It should be recognized that the present invention permits any design-change, unless it deviates from the soul, if it is within the limits by which the claim was performed.

INDUSTRIAL APPLICABILITY

The packing device for plate-like articles according to the present invention is suitably used to pack a plurality of glass plates when they are transported or stored.

The invention claimed is:

1. A packing device for plate-like articles, comprising:

a base frame a pair of rear frames upwardly disposed at rear both sides of the base frames so that the plate-like articles (G) to be packed are leaned against the rear pillars in a rearwardly leaned posture;

a pair of front pillars upwardly disposed at front both sides of the base frame; and a pressing device for pressing the plate-like articles (G) disposed on the base frame toward the rear pillars with the plate-like articles leaned against the rear pillars, wherein the pressing device has a pair of pressing members disposed along both front sides of the plate-like article (G) so as to be faced to the pair of front pillars, a pair of locking members to be disposed between the pair of pressing members and the pair of front pillars, and guide members for guiding the locking members in an up-and-down direction along the front pillars, wherein the pair of pressing members have groove shaped pressing plates to be disposed along an up-and-down direction with its opened groove direction faced to the front pillar, and the locking members are slidably inserted in grooves of the pressing plates 61, wherein in a state in which the plate-like articles (G) are disposed on the base frame with the plate-like article leaning against the rear pillars, the locking members each disposed between the front pillar and the pressing member are pressed downwardly along the front pillar to be disposed between the front pillar and the pressing member with the locking member engaged therebetween, whereby the pressing members press a front surface of the plate-like article.

2. The packing device for plate-like articles as recited in claim 1, wherein the guide member includes a U-shaped groove portion provided at the locking member and opened to a front pillar side, and wherein the U-shaped groove portion is slidably fitted in the front pillar along the longitudinal direction thereof, whereby the locking member are slidably guided by the front pillar.

3. The packing device for plate-like articles as recited in claim 1, wherein the locking member is constituted so as to detachably attached to the pressing member.

* * * * *